US009136649B2

(12) United States Patent
Shih

(10) Patent No.: US 9,136,649 B2
(45) Date of Patent: Sep. 15, 2015

(54) HDMI TYPE-D CONNECTOR

(71) Applicant: Tyco Electronics Holdings (Bermuda) No. 7 Ltd., Pembroke (BM)

(72) Inventor: Yi Liang Shih, Taipei (TW)

(73) Assignee: Tyco Electronics Holdings (Bermuda) No. 7 Ltd., Pembroke (BM)

( * ) Notice: Subject to any disclaimer, the term of this patent is extended or adjusted under 35 U.S.C. 154(b) by 155 days.

(21) Appl. No.: 13/922,923

(22) Filed: Jun. 20, 2013

(65) Prior Publication Data

US 2013/0344739 A1 Dec. 26, 2013

(30) Foreign Application Priority Data

Jun. 21, 2012 (TW) ..... 101211947 U

(51) Int. Cl.

| | |
|---|---|
| ***H01R 31/06*** | (2006.01) |
| ***H01R 13/658*** | (2011.01) |
| ***H01R 12/72*** | (2011.01) |
| ***H01R 13/6467*** | (2011.01) |
| *H01R 13/6582* | (2011.01) |

(52) U.S. Cl.
CPC ..... *H01R 13/658* (2013.01); *H01R 12/721* (2013.01); *H01R 13/6467* (2013.01); *H01R 13/6582* (2013.01)

(58) Field of Classification Search
USPC ..... 439/607.28, 607.4, 626, 607.45, 660, 439/904, 108, 638
See application file for complete search history.

(56) References Cited

U.S. PATENT DOCUMENTS

| | | | | |
|---|---|---|---|---|
| 6,561,849 | B2 | 5/2003 | Naito et al. | |
| 7,270,571 | B1 * | 9/2007 | Huang et al. | 439/607.45 |
| 7,497,704 | B2 | 3/2009 | Saito et al. | |
| 8,333,614 | B2 * | 12/2012 | Xiong et al. | 439/660 |
| 8,419,474 | B2 * | 4/2013 | Zhang et al. | 439/607.25 |
| 8,740,649 | B2 * | 6/2014 | Lan et al. | 439/607.4 |
| 2010/0297884 | A1 * | 11/2010 | Hung et al. | 439/626 |

FOREIGN PATENT DOCUMENTS

| | | |
|---|---|---|
| TW | 369574 U | 11/2009 |

* cited by examiner

*Primary Examiner* — Jean F Duverne
(74) *Attorney, Agent, or Firm* — Barley Snyder

(57) ABSTRACT

The present invention provides a HDMI type-D connector with a shield; a housing having a tongue with first terminal slots disposed on a first side and second terminal slots disposed on an opposing second side; a shield component; a first conductive set of pins disposed in the first terminal slots; and a second conductive set of pins disposed in the second terminal slots, wherein each of the conductive terminals of the first conductive set of pins and the second conductive set of pins has a contact portion, a bend portion, and a soldering portion, where contact portions of the first conductive set of pins are disposed in the first terminal slots and the second conductive set of pins are disposed in the second terminal slots wherein the bend portions extend from the contact portions, bend multiple times, and end at coplanar soldering portions.

10 Claims, 9 Drawing Sheets

HDMI TYPE-D CONNECTOR

BACKGROUND

1. Field of the Invention

The present invention relates to HDMI type-D connectors, and more particularly, to a HDMI type-D connector with coplanar soldering portions to reduce terminal cross-talk interference and save casing space.

2. Description of the Prior Art

Due to technological advancement, the resolution of display devices is increasingly high. At present, commercially-available liquid-crystal-display televisions are usually equipped with a high-definition multimedia interface (HDMI) or a display port interface for connection with a computer or any other video device. HDMI is designed for use in transmission of fully digitalized images and sound and is effective in transmitting uncompressed audio signals and video signals. The HDMI is applicable to set-top boxes, DVD players, personal computers, video game consoles, integrated amplifiers, digital hi-fi, and TV sets. Furthermore, HDMI is effective in transmitting an audio signal and a video signal concurrently and simplifying installation of a system greatly, because the audio and video signals share the same cable.

Since its inception, HDMI has rapidly evolved into the digital interface standard of consumer electronics products worldwide. From digital TV to DVD, various HDMI interface-equipped products are in wide use worldwide, allowing consumers the opportunity for enhanced digital experiences. HDMI specifications set forth four HDMI connector types, namely HDMI type A connectors, HDMI type B connectors, HDMI type C connectors, and HDMI type-D connectors.

According to HDMI standards published by HDMI Association, a HDMI type-D connector has 19 pins, defining pin 1 as Hot Plug Detect, pin 2 as Utility, pin 3 as transition-minimized differential signaling data 2+ (TMDS Data2+), pin 4 as transition-minimized differential signaling data 2 shield (TMDS Data2 Shield), pin 5 as transition-minimized differential signaling data 2− (TMDS Data2−), pin 6 as transition-minimized differential signaling data 1+ (TMDS Data1+), pin 7 as transition-minimized differential signaling data 1 shield (TMDS Data1 Shield), pin 8 as transition-minimized differential signaling data 1− (TMDS Data1−), pin 9 as transition-minimized differential signaling data 0+ (TMDS Data0+), pin 10 as transition-minimized differential signaling data 0 shield (TMDS Data0 Shield), pin 11 as transition-minimized differential signaling data 0− (TMDS Data0−), pin 12 as transition-minimized differential signaling clock+ (TMDS Clock+), pin 13 as transition-minimized differential signaling clock shield (TMDS Clock Shield), pin 14 as transition-minimized differential signaling clock− (TMDS Clock−), pin 15 as consumer electronics control (CEC), pin 16 as display data channel/consumer electronics control ground (DDC/CEC Ground), pin 17 as serial clock (SCL), pin 18 as serial data (SDA), and pin 19 as +5V power (+5 Power).

Conductive terminals (not shown) of a conventional HDMI type-D connector are arranged on the upper and lower sides at the rear of the electrical connector, such that soldering portions of the conductive terminals of the conventional HDMI type-D connector are characterized by an upper-row and lower-row arrangement. To enable the conventional HDMI type-D connector to be connected to a circuit board, it is necessary for Surface Mount Technology (SMT) contacts to be disposed on the top side and the bottom side of the circuit board such that the circuit board can be electrically connected to the HDMI type-D connector.

Hence, the circuit board has to have two layers of layout; however, the two layers of layout add to the manufacturing costs of the circuit board. Since the conductive terminals of the conventional HDMI type-D connector are characterized by the upper-row and lower-row arrangement, they are susceptible to cross-talk interference when operating at a high frequency.

As a result, transmission quality is either compromised, or the thickness of the casing is increased to reduce the cross-talk interference.

To solve the aforesaid problems, Taiwan patent I323531 discloses an electrical connector that suppresses cross-talk and comprises: a pair of signal contact plates with contact portions placed at a first row and spaced apart by a distance; ground contact plates with contact portions placed at a second row and facing the distance, wherein terminal portions of the pair of signal contact plates and the ground contact plates are disposed at a third row, and the terminal portions of the ground contact plates are adjacent to corresponding ones of the terminal portions of the pair of signal contact plates, respectively, to thereby reduce cross-talk between adjacent contact plates.

Furthermore, Taiwan patent 540187 discloses an electrical connector assembly that reduces cross-talk interference, wherein conductor electrodes are alternately arranged on two surfaces of a base board and in the lengthwise direction of the base board. One of the conductor electrodes transmits + differential signals, and another one of conductor electrodes transmits − differential signals. The conductor electrodes which transmit + differential signals and − differential signals are disposed on the forward lateral surface of the base board. A ground electrode is disposed on the opposing lateral surface of the base board and positioned between the conductor electrode transmitting + differential signals and the conductor electrode transmitting - differential signals to prevent cross-talk.

Furthermore, Taiwan patent M369574 discloses an electrical connector with contacts comprising a first signal differential pair, a second signal differential pair, and a third signal differential pair. The first signal differential pair and the third signal differential pair flank the second signal differential pair. Adjacent differential pairs are spaced apart by a power contact or a ground contact to thereby reduce interference which might otherwise be caused by cross-talk during high-speed transmission, thereby preventing cross-talk.

Each of these disclosed connectors comprise a pair of signal terminals and a ground terminal, which are characterized by an alternate arrangement to reduce or even prevent cross-talk. However, the arrangement of the terminals of these patented connectors is intricate, and thus the structure of the die for the terminal is also intricate. Accordingly, there is a need to develop alternative designs that are capable of reducing cross-talk interference between the conductive terminals, while simultaneously reducing design costs of the circuit board and saving casing space.

SUMMARY

It is an objective of the present invention to provide a HDMI type-D connector characterized by a unique arrangement, structure, and design of terminals to thereby cut design costs of a circuit board and save a casing space.

Another objective of the present invention is to provide a HDMI type-D connector that reduces cross-talk interference between conductive terminals.

The present invention provides a HDMI type-D connector with a shield having a housing receiving opening; a housing disposed in the housing receiving opening and having a tongue, the tongue having first terminal slots disposed on a first side and second terminal slots disposed on an opposing second side; a shield component disposed on the shield to prevent electromagnetic interference; a first conductive set of pins disposed in the first terminal slots and having a plurality of conductive terminals; and a second conductive set of pins disposed in the second terminal slots and having a plurality of conductive terminals, wherein each of the conductive terminals of the first conductive set of pins and the second conductive set of pins has a contact portion, a bend portion, and a soldering portion, wherein the contact portions of the first conductive set of pins are disposed in the first terminal slots and the second conductive set of pins are disposed in the second terminal slots wherein the bend portions extend from the contact portions, bend multiple times, and end at the soldering portions, to form coplanar soldering portions of the first conductive set of pins and the second conductive set of pins.

DETAILED DESCRIPTION OF THE EMBODIMENT(S)

Figure 1A:
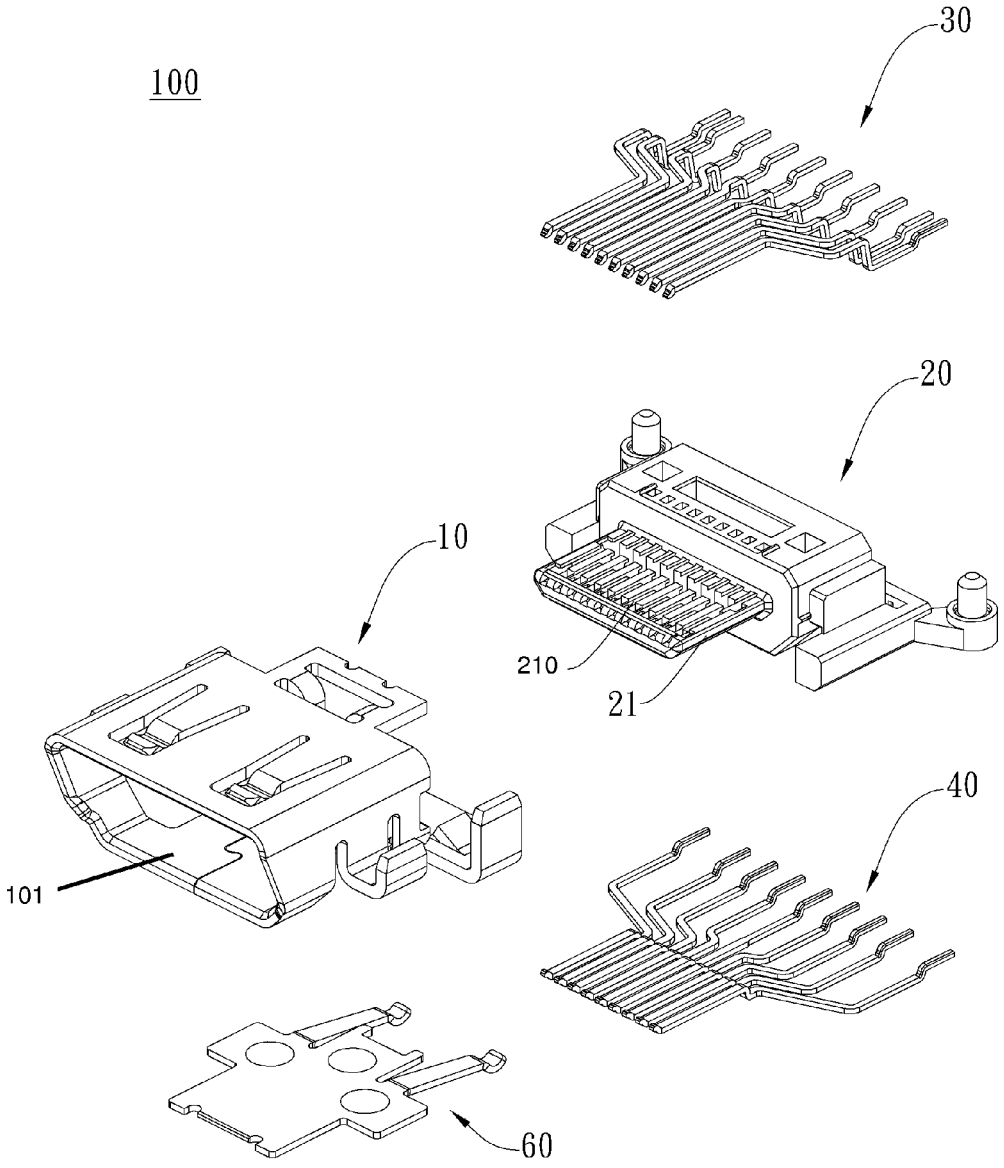
FIG. 1A is an exploded view of a HDMI type-D connector viewed from above.
Figure 1B:
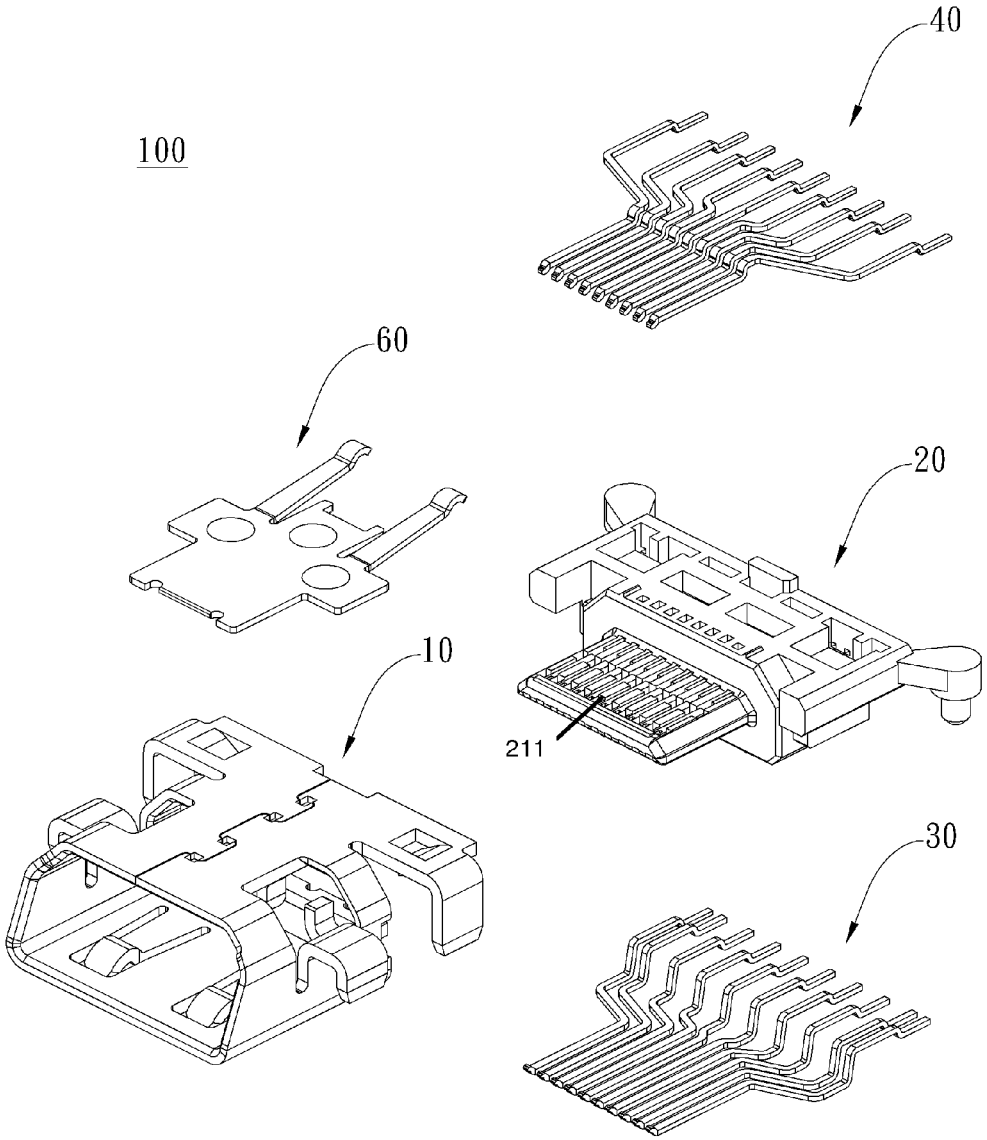
FIG. 1B is an exploded view of the HDMI type-D connector viewed from below.
Figure 1C:
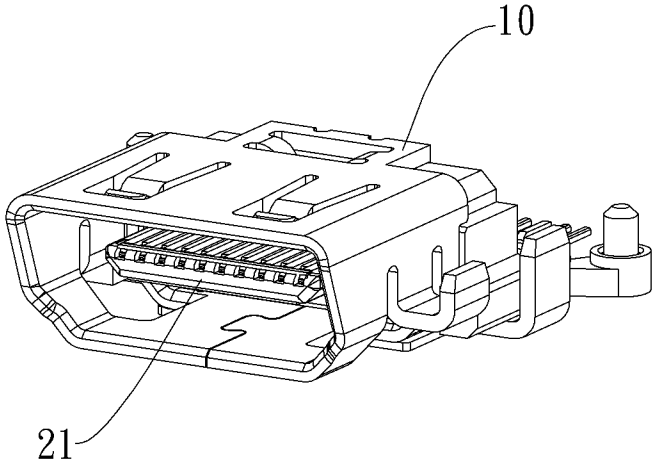
FIG. 1C is an assembled perspective view of the HDMI type-D connector.
Figure 1D:
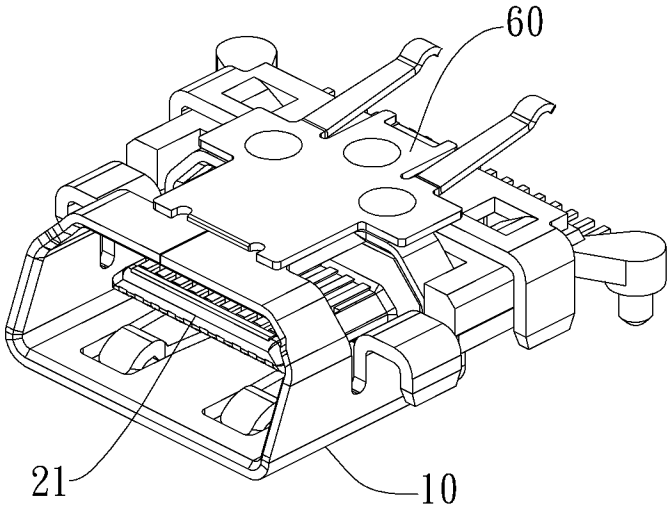
FIG. 1D is an assembled perspective view of the HDMI type-D connector taken at a different angle than FIG. 1C.

A specific embodiment of the present invention is described hereunder. The specific embodiment thus described is illustrative of the present invention. The scope of the present invention is not limited to the specific embodiment that describes specific features, structures, or properties, but is defined by the appended claims. The accompanying drawings do not depict all the unnecessary features of the present invention. The components shown in the accompanying drawings are depicted in a simplified schematic manner and may be enlarged or drawn not to scale for the sake of illustration. Whether they are described concisely or in detail, the features of the present invention fall into the scope of knowledge that can be implemented by persons skilled in the art together with other specific embodiments pertaining to the aforesaid features, structures, or properties.

Referring to FIG. 1A through FIG. 1D, an HDMI type-D connector 100 of the present invention comprises a shield 10, a housing 20, a shield component 60, a first conductive set of pins 30, and a second conductive set of pins 40. The shield 10 has a housing receiving opening 101. The housing 20 is disposed in the housing receiving opening 101 and has a tongue 21. First terminal slots 210 are disposed on a first side of the tongue 21. Second terminal slots 211 are disposed on an opposing second side of the tongue 21. The first terminal slots 210 and the second terminal slots 211 space apart the conductive terminals to prevent contact there between and cross-talk interference. The shield component 60 is disposed on the shield 10 to prevent electromagnetic interference. The first conductive terminal set 30 is disposed in the first terminal slots 210 and has a plurality of conductive terminals. The second conductive terminal set 40 is disposed in the second terminal slots 211 and has a plurality of conductive terminals.

Figure 2A:
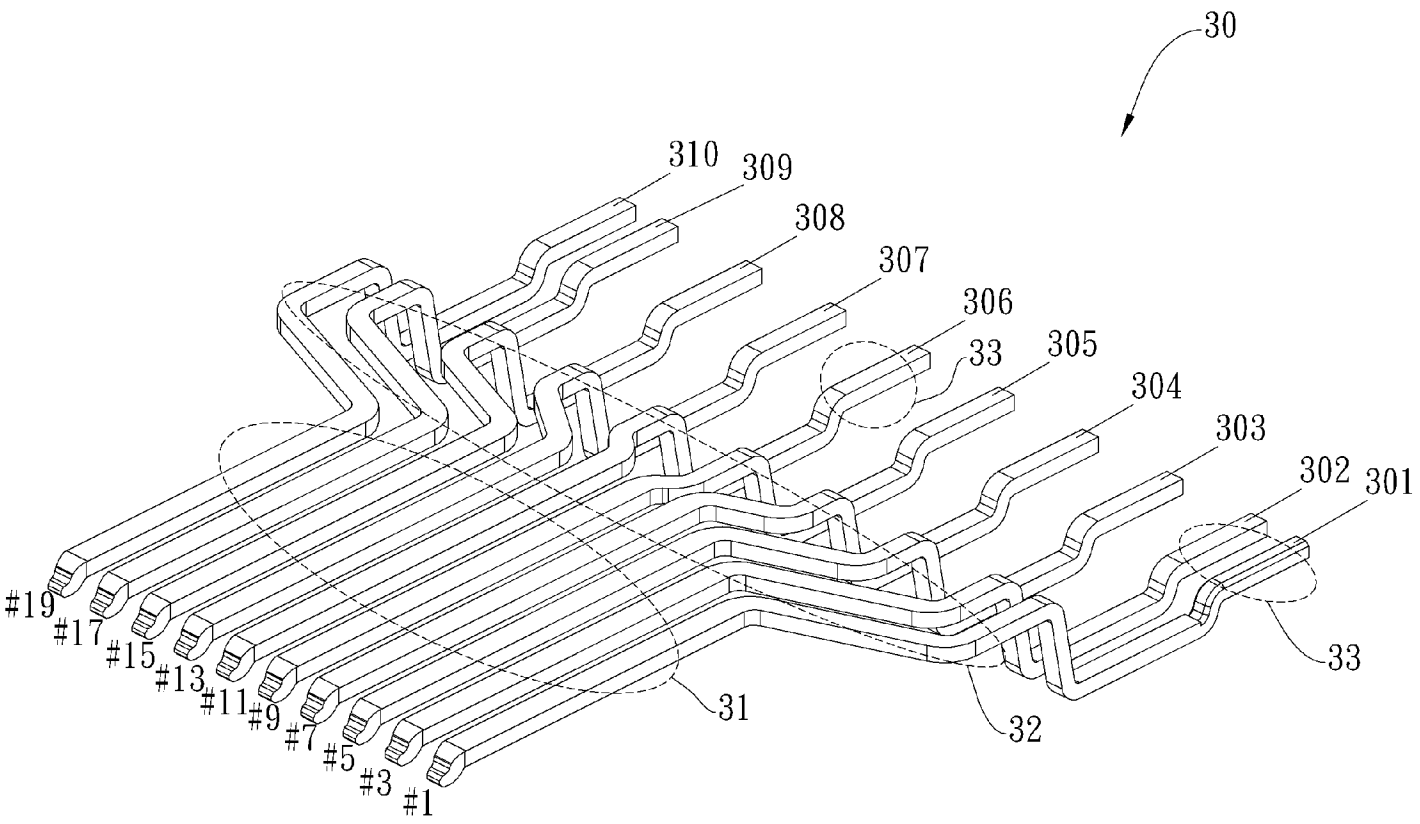
FIG. 2A is a perspective view of a first conductive terminal set.
Figure 2B:
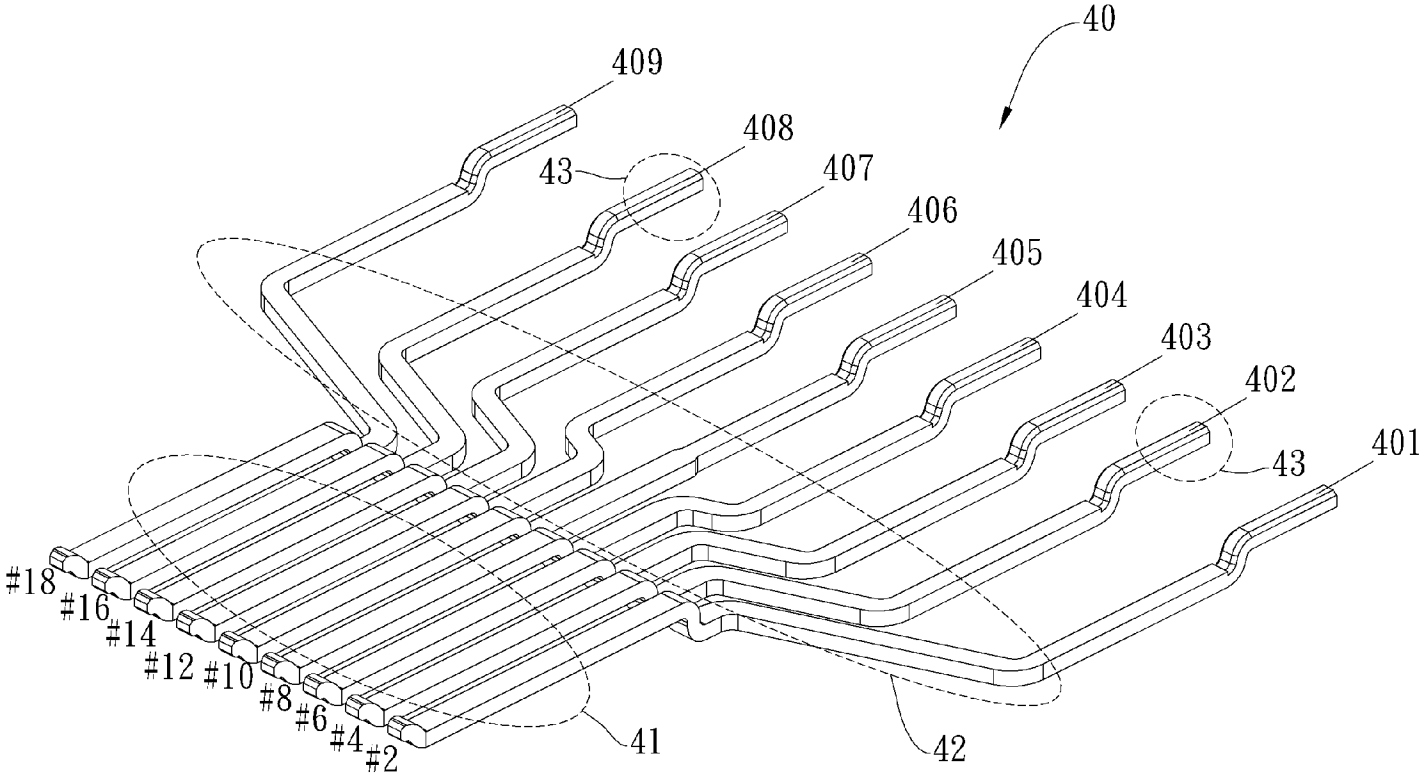
FIG. 2B is a perspective view of a second conductive terminal set.
Figure 2C:
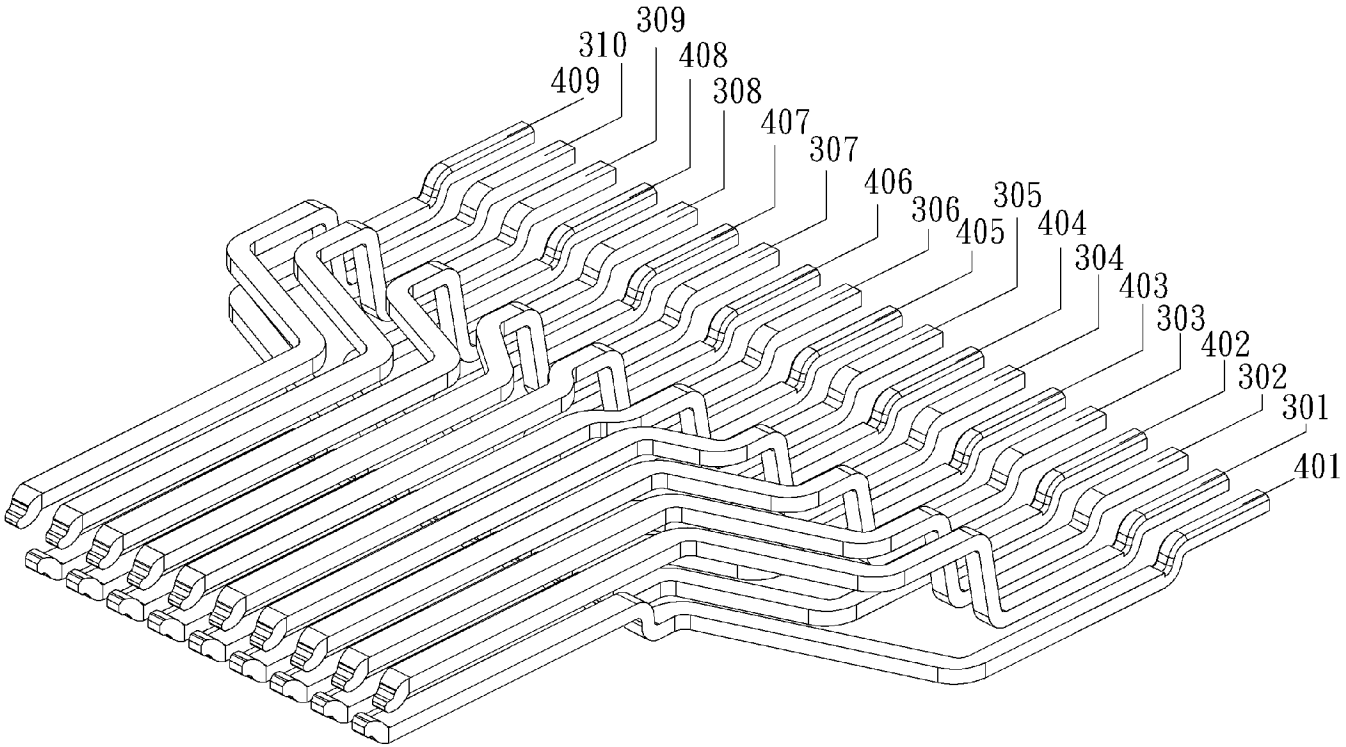
FIG. 2C is an assembled perspective view of the first conductive terminal set and the second conductive terminal set.

Referring to FIG. 2A through FIG. 2C, each of conductive terminals of the first conductive terminal set 30 has a contact portion 31, a bend portion 32, and a soldering portion 33. The contact portions 31 are disposed in the first terminal slots 210 on the first side of the tongue 21 of the housing 20, respectively. The contact portions 31 of the conductive terminals of the first conductive terminal set 30 are disposed in the first terminal slots 210, respectively, in the following sequence: a hot plug detect terminal 301, a first high-speed signal terminal A 302, a first high-speed signal terminal B 303, a second high-speed signal shield terminal 304, a third high-speed signal terminal A 305, a third high-speed signal terminal B 306, a fourth high-speed clock signal shield terminal 307, a consumer electronics control terminal 308, a serial clock terminal 309, and a +5V power terminal 310.

Each of conductive terminals of the second conductive terminal set 40 has a contact portion 41, a bend portion 42, and a soldering portion 43. The contact portions 41 are disposed in the second terminal slots 211 on the opposing second side of the tongue 21 of the housing 20, respectively. The contact portions 41 of the conductive terminals of the second conductive terminal set 40 are disposed in the second terminal slots 211, respectively, in the following terminal-related sequence: a utility terminal 401, a first high-speed signal shield terminal 402, a second high-speed signal terminal A 403, a second high-speed signal terminal B 404, a third high-speed signal shield terminal 405, a fourth high-speed clock signal terminal A 406, a fourth high-speed clock signal terminal B 407, a display data channel/consumer electronics control ground terminal 408, and a serial data terminal 409.

The contact portions 31 of the first conductive set of pins 30 and the contact portions 41 of the second conductive set of pins 40 are disposed in the first terminal slots 210 and the second terminal slots 211, respectively, such that the first conductive set of pins 30 and the second conductive set of pins 40 are characterized by an upper-and-lower-terminals arrangement.

The bend portions 32, 42 extend from the contact portions 31, 41, bend multiple times, and eventually end at the soldering portions 33, 43, respectively. The alternate arrangement and multiple-bend features of the first conductive set of pins 30 and the second conductive set of pins 40 enable the soldering portions 33, 43 of the first conductive set of pins 30 and the second conductive set of pins 40 to be coplanar, as shown in FIG. 2C, and thereby reduce terminal cross-talk interference effectively.

In this embodiment, the distance between the hot plug detect terminal 301 and the first high-speed signal terminal A 302 equals the distance between the serial clock terminal 309 and the +5V power terminal 310, whereas the first high-speed signal terminal B 303, the second high-speed signal shield terminal 304, the third high-speed signal terminal A 305, the third high-speed signal terminal B 306, the fourth high-speed clock signal shield terminal 307, and the consumer electronics control terminal 308 are arranged in sequence and spaced apart equidistantly, such that the position-related relationship between the terminals is characterized by regular symmetry. The distance between the hot plug detect terminal 301 and the first high-speed signal terminal A 302 and the distance between the serial clock terminal 309 and the +5V power terminal 310 are shorter than the distance by which the first high-speed signal terminal B 303, the second high-speed signal shield terminal 304, the third high-speed signal terminal A 305, the third high-speed signal terminal B 306, the fourth high-speed clock signal shield terminal 307, and the consumer electronics control terminal 308 are spaced apart.

The distance between the utility terminal 401 and the first high-speed signal shield terminal 402 equals the distance between the display data channel/consumer electronics control ground terminal 408 and the serial data terminal 409, whereas the second high-speed signal terminal A 403, the second high-speed signal terminal B 404, the third high-speed signal shield terminal 405, the fourth high-speed clock signal terminal A 406, and the fourth high-speed clock signal terminal B 407 are arranged in sequence and spaced apart equidistantly, such that the position-related relationship between the terminals is characterized by regular symmetry. The distance between the utility terminal 401 and the first high-speed signal shield terminal 402 and the distance between the display data channel/consumer electronics control ground terminal 408 and the serial data terminal 409 are greater than the distance by which the second high-speed signal terminal A 403, the second high-speed signal terminal B 404, the third high-speed signal shield terminal 405, the fourth high-speed clock signal terminal A 406, and the fourth high-speed clock signal terminal B 407 are spaced apart.

In this embodiment, the first high-speed signal terminal A 302, the second high-speed signal terminal A 403, the third high-speed signal terminal A 305, and the fourth high-speed clock signal terminal A 406 are positive signal terminals, whereas the first high-speed signal terminal B 303, the second high-speed signal terminal B 404, the third high-speed signal terminal B 306, and the fourth high-speed clock signal terminal B 407 are negative signal terminals, wherein the interference between the terminals is reduced by the first high-speed signal shield terminal 402, the second high-speed signal shield terminal 304, the third high-speed signal shield terminal 405, and the fourth high-speed clock signal shield terminal 307.

In this embodiment, the contact portions 31 of the conductive terminals of the first conductive set of pins 30 are characterized by an odd-number serial arrangement, such that the hot plug detect terminal 301 is assigned to pin 1, the first high-speed signal terminal A 302 to pin 3, the first high-speed signal terminal B 303 to pin 5, the second high-speed signal shield terminal 304 to pin 7, the third high-speed signal terminal A 305 to pin 9, the third high-speed signal terminal B 306 to pin 11, the fourth high-speed clock signal shield terminal 307 to pin 13, the consumer electronics control terminal 308 to pin 15, the serial clock terminal 309 to pin 17, and the +5V power terminal 310 to pin 19.

In this embodiment, the contact portions 41 of the conductive terminals of the second conductive set of pins 40 are characterized by an even-number serial arrangement, such that the utility terminal 401 is assigned to pin 2, the first high-speed signal shield terminal 402 to pin 4, the second high-speed signal terminal A 403 to pin 6, the second high-speed signal terminal B 404 to pin 8, the third high-speed signal shield terminal 405 to pin 10 , the fourth high-speed clock signal terminal A 406 to pin 12, the fourth high-speed clock signal terminal B 407 to pin 14, the display data channel/consumer electronics control ground terminal 408 to pin 16, and the serial data terminal 409 to pin 18.

The HDMI type-D connector 100 of the present invention provides that the alternate arrangement and multiple-bend features of the first conductive set of pins 30 and the second conductive set of pins 40 enable the soldering portions 33, 43 of the first conductive set of pins 30 and the second conductive set of pins 40 to be coplanar. The coplanar soldering portions of the first and second conductive terminal sets of pins are defined in the following sequence: the utility terminal 401, which is adjacent to the hot plug detect terminal 301, which is adjacent to the first high-speed signal terminal A 302, which is adjacent to the first high-speed signal shield terminal 402, which is adjacent to the first high-speed signal terminal B 303, which is adjacent to the second high-speed signal terminal A 403, which is adjacent to the second high-speed signal shield terminal 304, which is adjacent to the second high-speed signal terminal B 404, which is adjacent to the third high-speed signal terminal A 305, which is adjacent to the third high-speed signal shield terminal 405, which is adjacent to the third high-speed signal terminal B 306, which is adjacent to the fourth high-speed clock signal terminal A 406, which is adjacent to the fourth high-speed clock signal shield terminal 307, which is adjacent to the fourth high-speed clock signal terminal B 407, which is adjacent to the display data channel/consumer electronics control ground terminal 308, which is adjacent to the consumer electronics control terminal 408, which is adjacent to the serial clock terminal 309, which is adjacent to the +5V power terminal 310, which is adjacent to the serial data terminal 409.

Figure 3A:
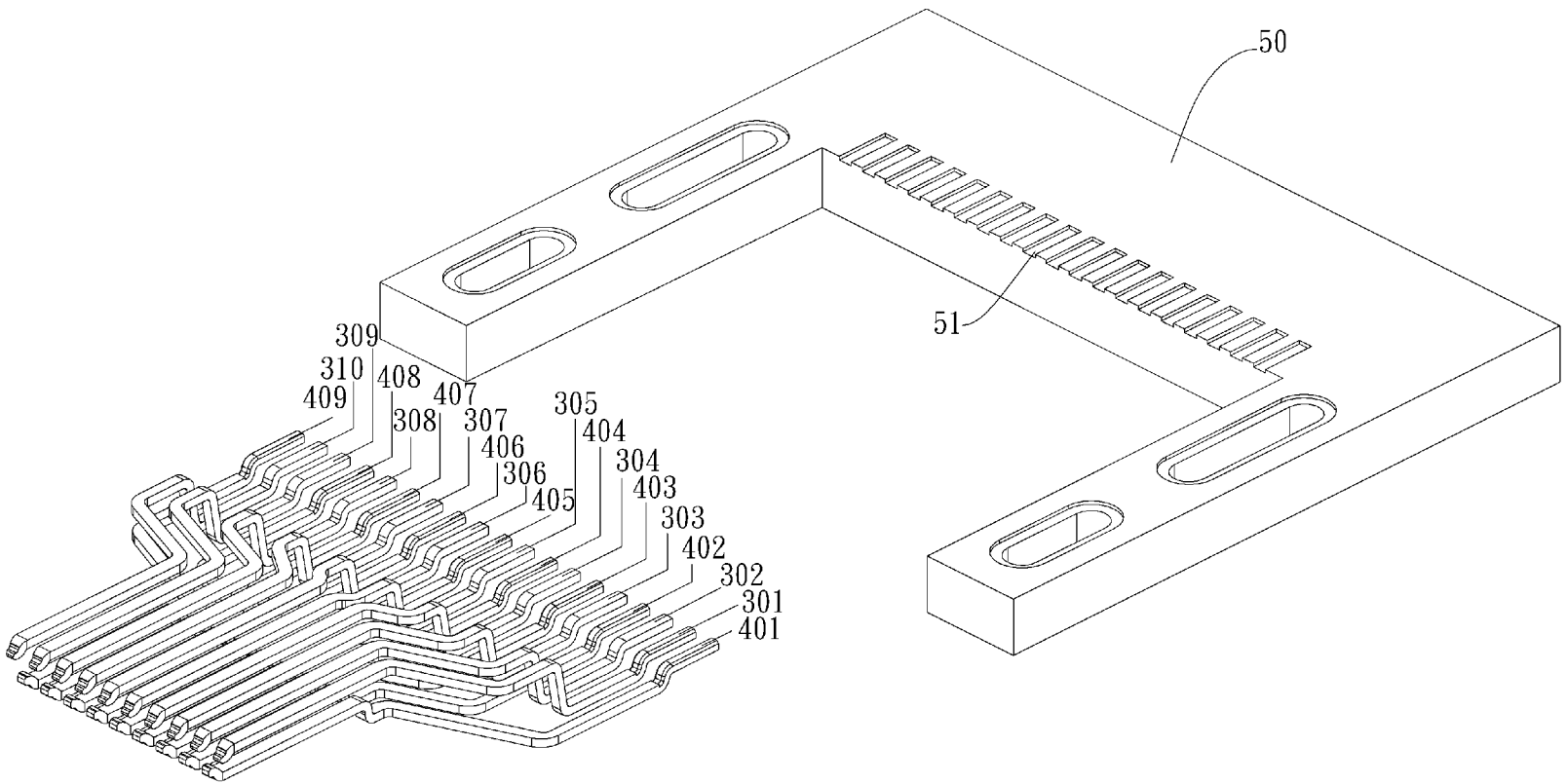
FIG. 3A is a disassembled schematic view of the HDMI type-D connector and a circuit board.
Figure 3B:
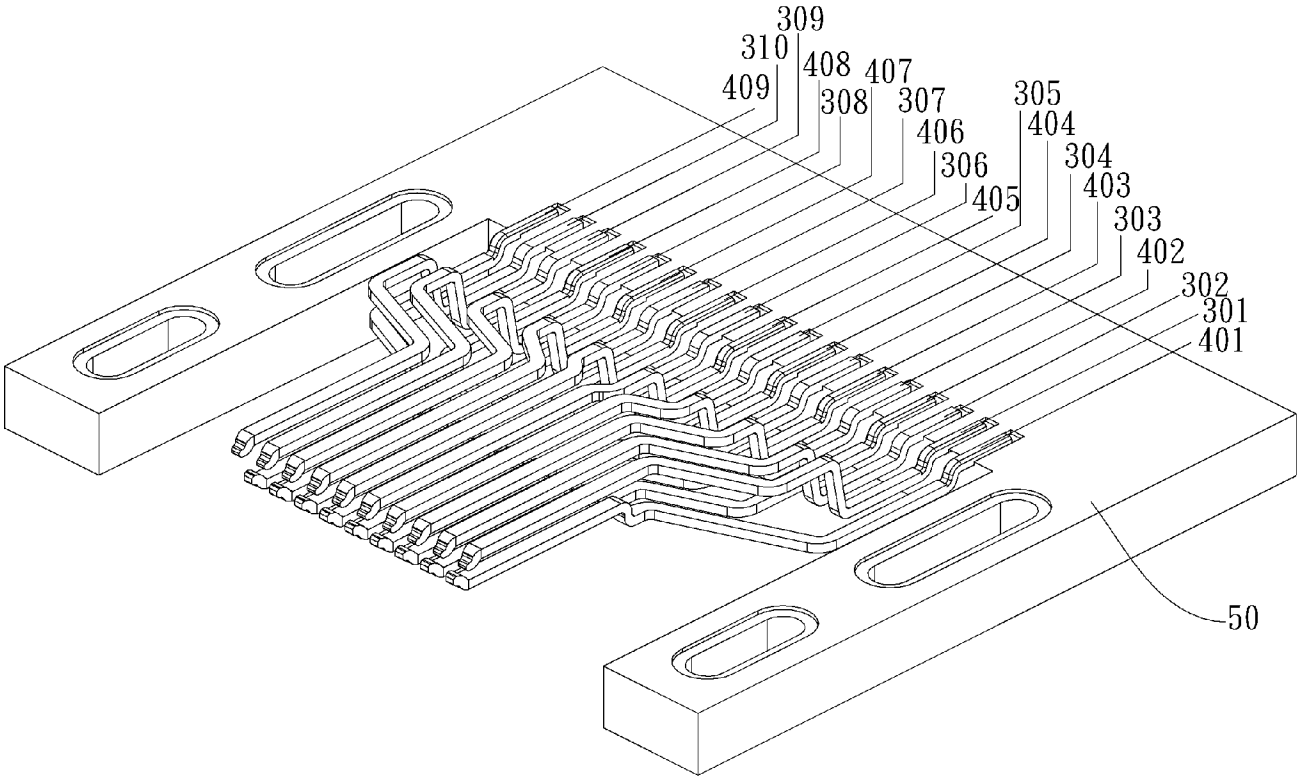
FIG. 3B is an assembled schematic view of the HDMI type-D connector coupled to the circuit board.

Referring to FIG. 3A and FIG. 3B, the HDMI type-D connector 100 is coupled to a circuit board 50, and a plurality of coplanar SMT contacts 51 is disposed on the circuit board 50. The soldering portions 33,43 of the first conductive set of pins 30 and the second conductive set of pins 40 correspond in position to the plurality of coplanar SMT contacts 51, in the following sequence: the utility terminal 401, which is adjacent to the hot plug detect terminal 301, which is adjacent to the first high-speed signal terminal A 302, which is adjacent to the first high-speed signal shield terminal 402, which is adjacent to the first high-speed signal terminal B 303, which is adjacent to the second high-speed signal terminal A 403, which is adjacent to the second high-speed signal shield terminal 304, which is adjacent to the second high-speed signal terminal B 404, which is adjacent to the third high-speed signal terminal A 305, which is adjacent to the third high-speed signal shield terminal 405, which is adjacent to the third high-speed signal terminal B 306, which is adjacent to the fourth high-speed clock signal terminal A 406, which is adjacent to the fourth high-speed clock signal shield terminal 307, which is adjacent to the fourth high-speed clock signal terminal B 407, which is adjacent to the display data channel/consumer electronics control ground terminal 308, which is adjacent to the consumer electronics control terminal 408, which is adjacent to the serial clock terminal 309, which is adjacent to the +5V power terminal 310, which is adjacent to the serial data terminal 409, and are arranged in sequence, spaced apart, and coupled to the coplanar SMT contacts 51 of the circuit board 50.

Referring to FIG. 3B, due to the coplanar soldering portions 33, 43 of the HDMI type-D connector 100, the layout of the circuit board 50 only needs to be provided in the form of a monolayer, thereby effectively saving space and cutting manufacturing costs of the circuit board.

There are multiple advantages to this design, not only is the unique terminal arrangement and structure of the first conductive set of pins 30 and the second conductive set of pins 40 conducive to cutting circuit board design costs and saving a casing space, but the position-related relationship between the conductive terminals of the first conductive set of pins 30 and the second conductive set of pins 40 is also characterized by regular symmetry, such that the die for the terminal has a simple structure and thus is easy to manufacture. Additionally, the shield component is disposed on the bottom surface of the shield, which prevents electromagnetic interference.

One of ordinary skill in the art would appreciate that various changes or modifications can be made to the described embodiments without departing from the principles and spirit of the disclosure, the scope of which is defined in the appended claims and their equivalents.

What is claimed is:

1. A HDMI type-D connector, comprising:

a shield having a housing receiving opening;

a housing disposed in the housing receiving opening and having a tongue, the tongue having first terminal slots disposed on a first side and second terminal slots disposed on an opposing second side;

a shield component disposed on the shield to prevent electromagnetic interference;

a first conductive set of pins disposed in the first terminal slots and having a plurality of conductive terminals; and a second conductive set of pins disposed in the second terminal slots and having a plurality of conductive terminals, wherein each of the conductive terminals of the first conductive set of pins and the second conductive set of pins has a contact portion, a bend portion, and a soldering portion, wherein the contact portions of the first conductive set of pins are disposed in the first terminal slots and the second conductive set of pins are disposed in the second terminal slots wherein the bend portions extend from the contact portions, bend multiple times, and end at the soldering portions, to form coplanar soldering portions of the first conductive set of pins and the second conductive set of pins.

2. The HDMI type-D connector of claim 1, wherein the contact portions of the conductive terminals of the first conductive set of pins are disposed in the first terminal slots in the following sequence:

pin 1 is a hot plug detect terminal and is adjacent to pin 3, pin 3 is a first high-speed signal terminal A and is adjacent to pins 1 and 5, pin 5 is a first high-speed signal terminal B and is adjacent to pins 3 and 7, pin 7 is a second high-speed signal shield terminal and is adjacent to pins 5 and 9, pin 9 is a third high-speed signal terminal A and is adjacent to pins 7 and 11, pin 11 is a third high-speed signal terminal B and is adjacent to pins 9 and 13, pin 13 is a fourth high-speed clock signal shield terminal and is adjacent to pins 11 and 15, pin 15 is a consumer electronics control terminal and is adjacent to pins 13 and 17, pin 17 is a serial clock terminal and is adjacent to pins 15 and 19, and pin 19 is a +5V power terminal and is adjacent to pin 17.

3. The HDMI type-D connector of claim 2, wherein a distance between the hot plug detect terminal and the first high-speed signal terminal A equals a distance between the serial clock terminal and the +5V power terminal, and the first high-speed signal terminal B, the second high-speed signal shield terminal, the third high-speed signal terminal A, the third high-speed signal terminal B, the fourth high-speed clock signal shield terminal, and the consumer electronics control terminal are arranged in sequence and spaced apart equidistantly.

4. The HDMI t e-D connector of claim 3, wherein a distance between the hot plug detect terminal and the first high-speed signal terminal A and a distance between the serial clock terminal and the +5V power terminal are shorter than a distance by which the first high-speed signal terminal B, the second high-speed signal shield terminal, the third high-speed signal terminal A, the third high-speed signal terminal B, the fourth high-speed clock signal shield terminal, and the consumer electronics control terminal are spaced apart.

5. The HDMI type-D connector of claim 1, wherein the contact portions of the conductive terminals of the second conductive set of pins are disposed in the second terminal slots in the following sequence:

pin 2 is a utility terminal and is adjacent to pin 4, pin 4 is a first high-speed signal shield terminal and is adjacent to pins 2 and 6, pin 6 is a second high-speed signal terminal A and is adjacent to pins 4 and 8, pin 8 is a second high-speed signal terminal B and is adjacent to pins 6 and 10, pin 10 is a third high-speed signal shield terminal and is adjacent to pins 8 and 12, pin 12 is a fourth high-speed clock signal terminal A and is adjacent to pins 10 and 14, pin 14 is a fourth high-speed clock signal terminal B and is adjacent to pins 12 and pin 16 is a display data channel/consumer electronics control ground terminal and is adjacent to pins 14 and 18, and pin 18 is a serial data terminal and is adjacent to pin 16.

6. The HDMI type-D connector of claim 5, wherein a distance between the utility terminal and the first high-speed signal shield terminal equals a distance between the display data channel/consumer electronics control ground terminal and the serial data terminal, wherein the second high-speed signal terminal A, the second high-speed signal terminal B, the third high-speed signal shield terminal, the fourth high-speed clock signal terminal A, and the fourth high-speed clock signal terminal B are arranged in sequence and spaced apart equidistantly.

7. The HDMI type-D connector of claim 6, wherein a distance between the utility terminal and the first high-speed signal shield terminal and a distance between the display data channel/consumer electronics control ground terminal and the serial data terminal are greater than a distance by which the second high-speed signal terminal A, the second high-speed signal terminal B, the third high-speed signal shield terminal, the fourth high-speed clock signal terminal A, and the fourth high-speed clock signal terminal B are spaced apart.

8. The HDMI type-D connector of claim 1, wherein the coplanar soldering portions of the conductive terminals of the first conductive set of pins and the second conductive set of pins are in the following sequence:

a utility terminal, which is adjacent to a hot plug detect terminal, which is adjacent to a first high-speed signal terminal A, which is adjacent to a first high-speed signal shield terminal, which is adjacent to a first high-speed signal terminal B, which is adjacent to a second high-speed signal terminal A, which is adjacent to a second high-speed signal shield terminal, which is adjacent to a second high-speed signal terminal B, which is adjacent to a third high-speed signal terminal A, which is adjacent to a third high-speed signal shield terminal, which is adjacent to a third high-speed signal terminal B, which is adjacent to a fourth high-speed clock signal terminal A, which is adjacent to a fourth high-speed clock signal shield terminal, which is adjacent to a fourth high-speed clock signal terminal B, which is adjacent to a display data channel/consumer electronics control ground terminal, which is adjacent to a consumer electronics control terminal, which is adjacent to a serial clock terminal, which is adjacent to a +5V power terminal, which is adjacent to a serial data terminal.

9. The HDMI type-D connector of claim 1, wherein the coplanar soldering portions of the first conductive set of pins and the second conductive set of pins are coupled to a circuit board on which a plurality of coplanar Surface Mount Technology contacts is disposed.

10. A HDMI t e-D connector, comprising:

a shield having a housing receiving opening and a bottom surface;

a housing disposed in the housing receiving opening and having a tongue, the tongue having first terminal slots disposed on a first side and second terminal slots disposed on an opposing second side;

a shield component removably attached to the bottom surface of the shield to prevent electromagnetic interference;

a first conductive set of pins disposed in the first terminal slots and having a plurality of conductive terminals; and a second conductive set of pins disposed in the second terminal slots and having a plurality of conductive terminals, wherein each of the conductive terminals of the first conductive set of pins and the second conductive set of pins has a contact portion, a bend portion, and a soldering portion, wherein the contact portions of the first conductive set of pins are disposed in the first terminal slots and the second conductive set of pins are disposed in the second terminal slots wherein the bend portions extend from the contact portions, bend multiple times, and end at the soldering portions, to form coplanar soldering portions of the first conductive set of pins and the second conductive set of pins.

* * * * *